US005701391A

United States Patent [19]

Pan et al.

[11] Patent Number: 5,701,391

[45] Date of Patent: Dec. 23, 1997

[54] METHOD AND SYSTEM FOR COMPRESSING A SPEECH SIGNAL USING ENVELOPE MODULATION

[75] Inventors: Shao Wei Pan, Zurich; Shay-Ping Thomas Wang, Long Grove, both of Ill.

[73] Assignee: Motorola, Inc., Schaumburg, Ill.

[21] Appl. No.: 558,582

[22] Filed: Oct. 31, 1995

[51] Int. Cl.[6] ..... G10L 9/18

[52] U.S. Cl. ..... 395/2.21; 395/2.1; 395/2.15; 395/2.16; 395/2.17; 395/2.23

[58] Field of Search ..... 395/2.1, 2.15–2.17, 395/2.21, 2.23, 2.91, 2.94, 2.95

*Primary Examiner*—Allen R. MacDonald
*Assistant Examiner*—Alphonso A. Collins

[57] ABSTRACT

A speech signal is sampled to form a sequence of speech data and segmented into segments. The envelope of each segment is detected to form an envelope segment. Each datum of the segment is divided by each datum of the envelope segment to form a de-envelope segment which is transformed into spectral components. Dominant frequencies are determined for the spectral components with greatest magnitudes. Envelope coefficients are generated by fitting a polynomial function to the segment. Phase parameters are generated representing a phase of each of the dominant spectral components. The dominant frequencies, the envelope coefficients and the phase parameters are generated as compressed speech data for each voiced segment. For each unvoiced segment, a carrier frequency, an amplitude and at least one sideband frequency of an amplitude modulation component are generated as the compressed speech data.

20 Claims, 3 Drawing Sheets

METHOD AND SYSTEM FOR COMPRESSING A SPEECH SIGNAL USING ENVELOPE MODULATION

TECHNICAL FIELD

This invention relates generally to speech coding and, more particularly, to speech data compression.

BACKGROUND OF THE INVENTION

It is known in the art to convert speech into digital speech data. This process is often referred to as speech coding. The speech is converted to an analog speech signal with a transducer such as a microphone. The speech signal is periodically sampled and converted to speech data by, for example, an analog to digital converter. The speech data can then be stored by a computer or other digital device. The speech data can also be transferred among computers or other digital devices via a communications medium. As desired, the speech data can be converted back to an analog signal by, for example, a digital to analog converter, to reproduce the speech signal. The reproduced speech signal can then be amplified to a desired level to play back the original speech.

In order to provide a quality reproduced speech signal, the speech data must represent the original speech signal as accurately as possible. This typically requires frequent sampling of the speech signal, and thus produces a high volume of speech data which may significantly hinder data storage and transfer operations. For this reason, various methods of speech compression have been employed to reduce the volume of the speech data. As a general rule, however, the greater the compression ratio achieved by such methods, the lower the quality of the speech signal when reproduced. Thus, a more efficient means of compression is desired which achieves a high compression ratio without significantly reducing the quality of the speech signal.

DESCRIPTION OF THE PREFERRED EMBODIMENT

Figure 1:
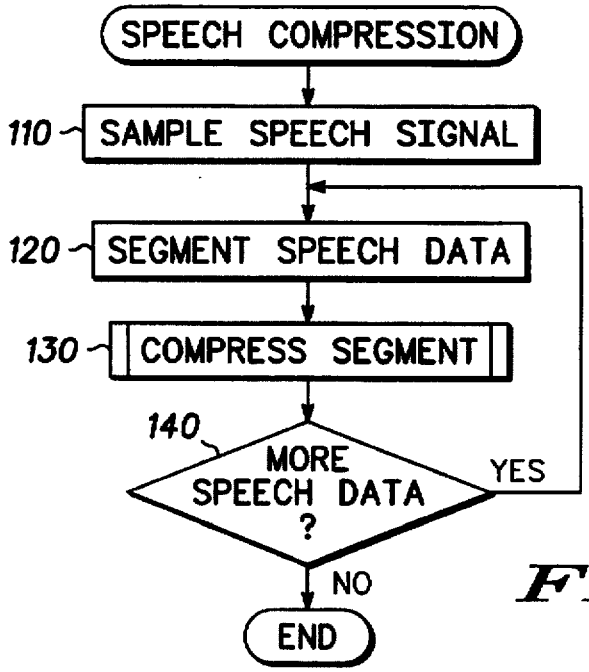
FIG. 1 is a flowchart of the overall speech compression process performed in a preferred embodiment of the invention.

In a preferred embodiment of the invention, a method and system are provided for compressing a speech signal into compressed speech data. To summarize the method of the preferred embodiment, a speech signal is initially sampled to form a sequence of speech data and segmented into segments. The envelope of each segment is detected to form an envelope segment. Each datum of the segment is then divided by each datum of the envelope segment to form a de-envelope segment. The de-envelope segment is transformed into spectral components. Dominant frequencies are determined for a number of dominant spectral components with the greatest magnitudes. Envelope coefficients are generated by fitting a polynomial function to the segment. Phase parameters are generated representing a phase of each of the dominant spectral components. The dominant frequencies, the envelope coefficients and the phase parameters are generated as compressed speech data for each voiced segment. For each unvoiced segment, a carrier frequency, an amplitude and at least one sideband frequency of an amplitude modulation component are generated as the compressed speech data.

To summarize the system of the preferred embodiment, a sampler initially samples the speech signal to form a sequence of speech data. A segmenter then segments the sequence of speech data into at least one subsequence of segmented speech data, called herein a segment. An envelope detector detects an envelope of the segment to form a subsequence of envelope data, called herein an envelope segment. An amplitude converter then divides each datum of the segment by a corresponding datum of the envelope segment to form a subsequence of de-envelope data, called herein a de-envelope segment.

A spectral analyzer transforms the de-envelope segment into one or more spectral components. A dominant frequency detector then determines one or more dominant frequencies corresponding to a predetermined number of dominant spectral components that have the greatest magnitudes. Additionally, an envelope coefficient generator generates one or more envelope coefficients by fitting a polynomial function to the envelope segment. Also, a phase parameter generator generates one or more phase parameters representing a phase of each of the dominant spectral components. The envelope coefficients, the dominant frequencies and the phase parameters are generated as the compressed speech data for each segment.

The system of a particularly preferred embodiment of the invention generates the above described compressed speech data for segments representing voiced speech, but generates a different type of compressed speech data for unvoiced speech. The particularly preferred embodiment includes an energy detector that determines whether an energy in the de-envelope data indicates that a segment represents voiced or unvoiced speech. The particularly preferred embodiment further includes an amplitude modulation parameter generator which generates amplitude modulation parameters for each segment that represents unvoiced speech. The energy detector determines the energy in the de-envelope data based on the spectral components and compares the energy to an energy threshold. If the energy is less than the energy threshold, the segment is determined to be unvoiced. If so, the energy detector invokes the amplitude modulation parameter generator. The amplitude modulation parameter generator identifies an amplitude modulation component from the spectral components and determines as the amplitude modulation parameters a carrier frequency, an amplitude and at least one sideband frequency of the amplitude modulation component. The carrier frequency, the amplitude and the sideband frequency of the amplitude modulation component are then generated as the compressed speech data for each segment representing unvoiced speech.

The method and system for compressing a speech signal using envelope modulation described herein provides the advantages of a high speech compression ratio with minimized loss of speech quality. The envelope modulation allows for the generation of a minimal number of parameters which accurately describe each segment. The compressed speech data can then be efficiently stored by a computer or other digital device. The compressed speech data can also be efficiently transferred among computers or other digital devices via a communications medium. Upon decompression, the speech data can be converted back to a quality speech signal and played or recorded.

FIG. 1 is a flowchart of the overall speech compression process performed in a preferred embodiment of the invention. It is noted that the flowcharts of the description of the preferred embodiment do not necessarily correspond directly to lines of software code or separate routines and subroutines, but are provided as illustrative of the concepts involved in the relevant process so that one of ordinary skill in the art will best understand how to implement those concepts in the specific configuration and circumstances at hand. It is also noted that decompression of the compressed speech data is essentially the reversal of the compression process described herein, and will be easily accomplished by one of ordinary skill in the art based on the description of the speech compression.

The speech compression method and system described herein may be implemented as software executing on a computer. Alternatively, the speech compression method and system may be implemented in digital circuitry such as one or more integrated circuits designed in accordance with the description of the preferred embodiment. One possible embodiment of the invention includes a polynomial processor designed to perform the polynomial functions which will be described herein, such as the polynomial processor described in "Neural Network and Method of Using Same", having Ser. No. 08/076,601, which is herein incorporated by reference. One of ordinary skill in the art will readily implement the method and system that is most appropriate for the circumstances at hand based on the description herein.

In step 110 of FIG. 1, a speech signal is sampled periodically to form a sequence of speech data. The speech signal is an analog signal which represents actual speech. In step 120, the sequence of speech data is segmented into at least one subsequence of segmented speech data, called herein a segment. In step 130, the segment is compressed, as will be explained below. In step 140, the steps 120 and 130 of segmenting the sequence of speech data and compressing each segment are repeated as long as the sequence of speech data contains more speech data. When the sequence of speech data contains no more speech data, the speech compression process ends.

Figure 2:
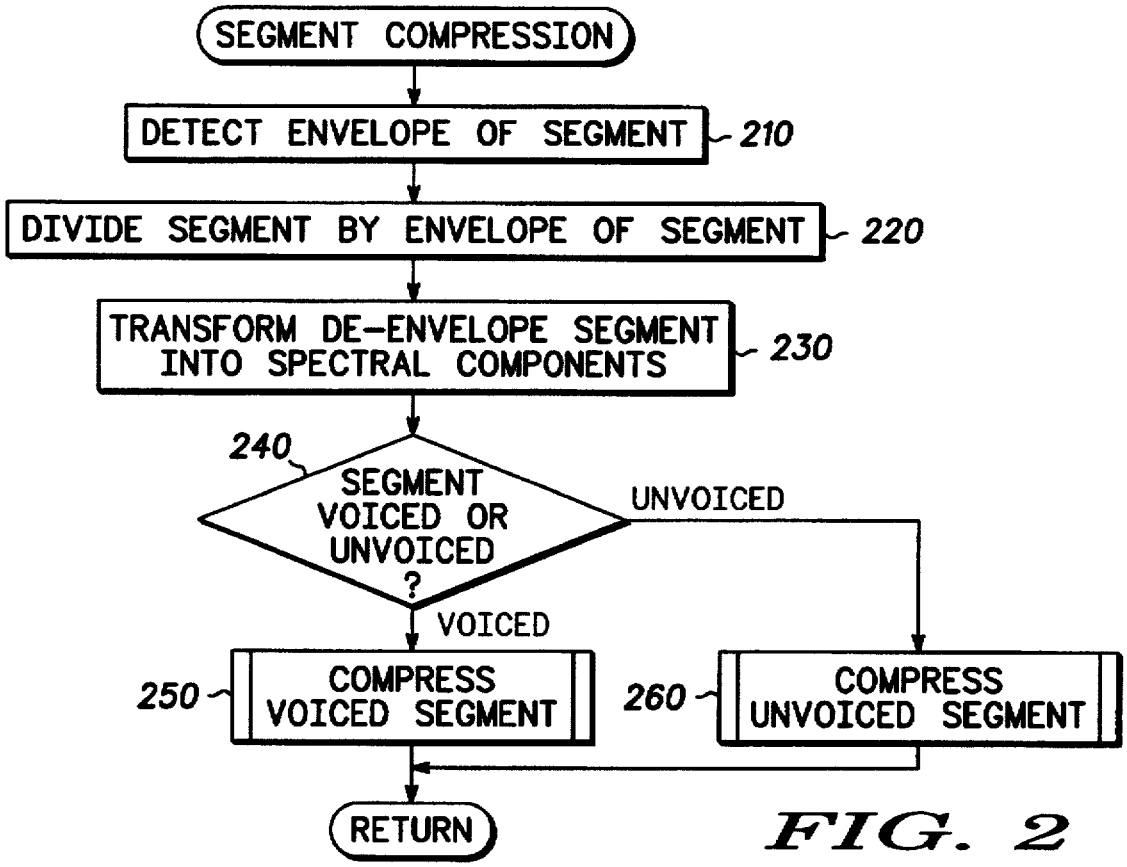
FIG. 2 is a flowchart of the segment compression process performed in a preferred embodiment of the invention.

FIG. 2 is a flowchart of the segment compression process performed on each segment in a preferred embodiment of the invention. The segment compression process shown in FIG. 2 corresponds to step 130 in FIG. 1. As noted above, the preferred embodiment of the invention utilizes envelope modulation to provide an optimum compression. The envelope of the segment is used to modulate the segment and to determine the parameters that will be used as compressed speech data. Initially, the envelope of the segment is detected to form a subsequence of envelope data, called herein an envelope segment. In an embodiment of the invention, the envelope is detected by determining peak amplitudes of the subsequence of segmented speech data. In another embodiment of the invention, the envelope is detected by truncating the segmented speech data in the segment that falls below a threshold to form a subsequence of truncated data, and then low-pass filtering the subsequence of truncated data to form the envelope segment.

In step 220, each datum of the segment is divided by a corresponding datum of the envelope segment to form a subsequence of de-envelope data, called herein a de-envelope segment. In step 230, the de-envelope segment is transformed into one or more spectral components. This transformation is accomplished, for example, by the use of a fast-Fourier transform or a discrete Fourier transform. In step 240, it is determined whether the segment is voiced or unvoiced. An energy of the de-envelope segment is determined based on the spectral components and compared to an energy threshold. If the energy in the de-envelope data is less than the energy threshold, the segment is determined to be unvoiced. Otherwise, the segment is determined to be voiced, and control proceeds to step 250 where the voiced segment is compressed. If the segment is determined to be unvoiced, control proceeds to step 260, where the unvoiced segment is compressed.

Figure 3:
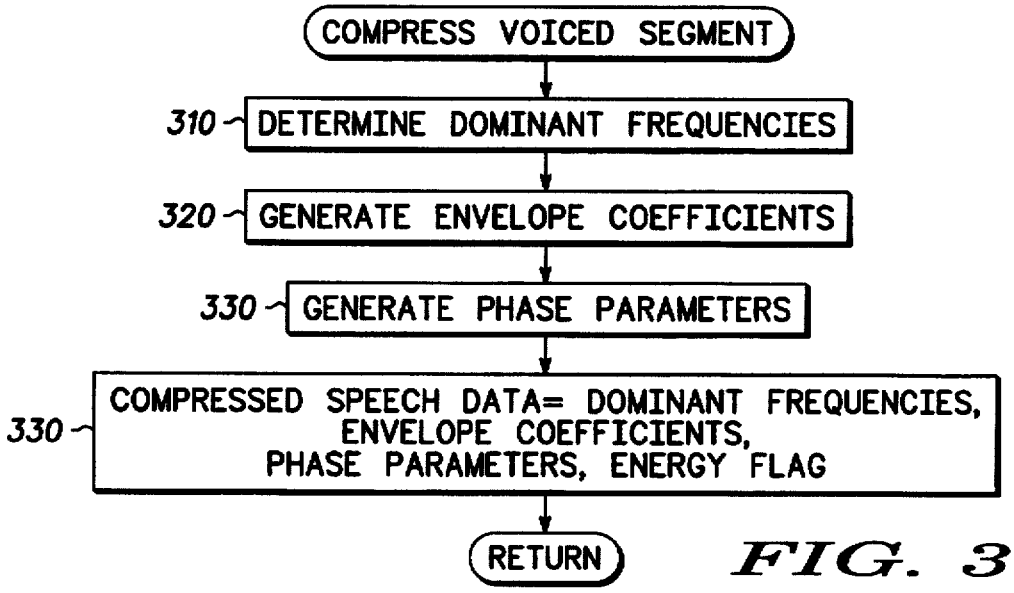
FIG. 3 is a flowchart of the voiced segment compression process performed in a preferred embodiment of the invention.

FIG. 3 is a flowchart of the voiced segment compression process performed in a preferred embodiment of the invention. FIG. 3 corresponds to step 250 of FIG. 2. Returning to FIG. 3, in step 310, a predetermined number of dominant frequencies are determined. The dominant frequencies are those frequencies which correspond to a predetermined number of dominant spectral components having the greatest magnitudes of the spectral components produced in step 230. Returning again to FIG. 3, in step 320, one or more envelope coefficients are generated by fitting the envelope segment to a polynomial function. Preferably, the envelope segment is fit to the polynomial function using a curve-fitting technique such as a least-squares method or a matrix-inversion method. In step 330, one or more phase parameters are generated representing a phase of each of the dominant spectral components. The phase coefficients are generated by fitting the de-envelope segment to a modeling equation, as will be explained in more detail later in the specification. Preferably, the de-envelope segment is fit to the modeling equation using a curve-fitting technique such as a least-squares method or a matrix-inversion method. In step 340, the dominant frequencies, the envelope coefficients and the phase parameters are generated as the compressed speech data for the voiced segment along with an energy flag indicating that the segment is voiced.

Figure 4:
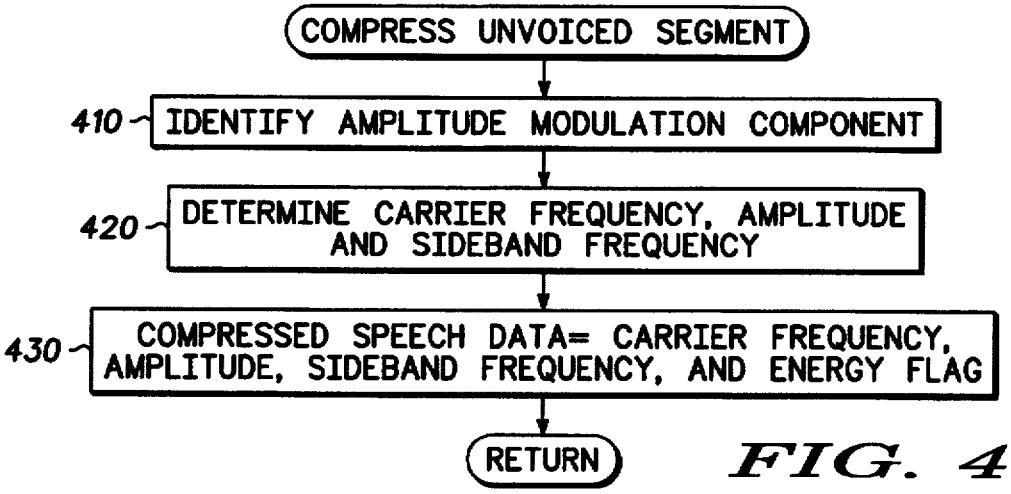
FIG. 4 is a flowchart of the unvoiced segment compression process performed in a preferred embodiment of the invention.

FIG. 4 is a flowchart of the unvoiced segment compression process performed in a preferred embodiment of the invention. In general, unvoiced speech requires less speech data to accurately represent the corresponding portion of the speech signal than voiced speech. Thus, in the preferred embodiment of the invention, an unvoiced segment is represented by amplitude modulation parameters, which allow for even more compression in the compressed speech data. In step 410, an amplitude modulation component is identified from among the spectral components. In step 420, the amplitude modulation parameters are generated. Specifically, as will be explained in more detail later in the specification, a carrier frequency, an amplitude and at least one sideband frequency of the amplitude modulation component are determined. In step 430, the carrier frequency, the amplitude and the sideband frequency of the amplitude modulation component are generated as the compressed speech data for the unvoiced segment along with an energy flag indicating that the segment is unvoiced.

Figure 5:
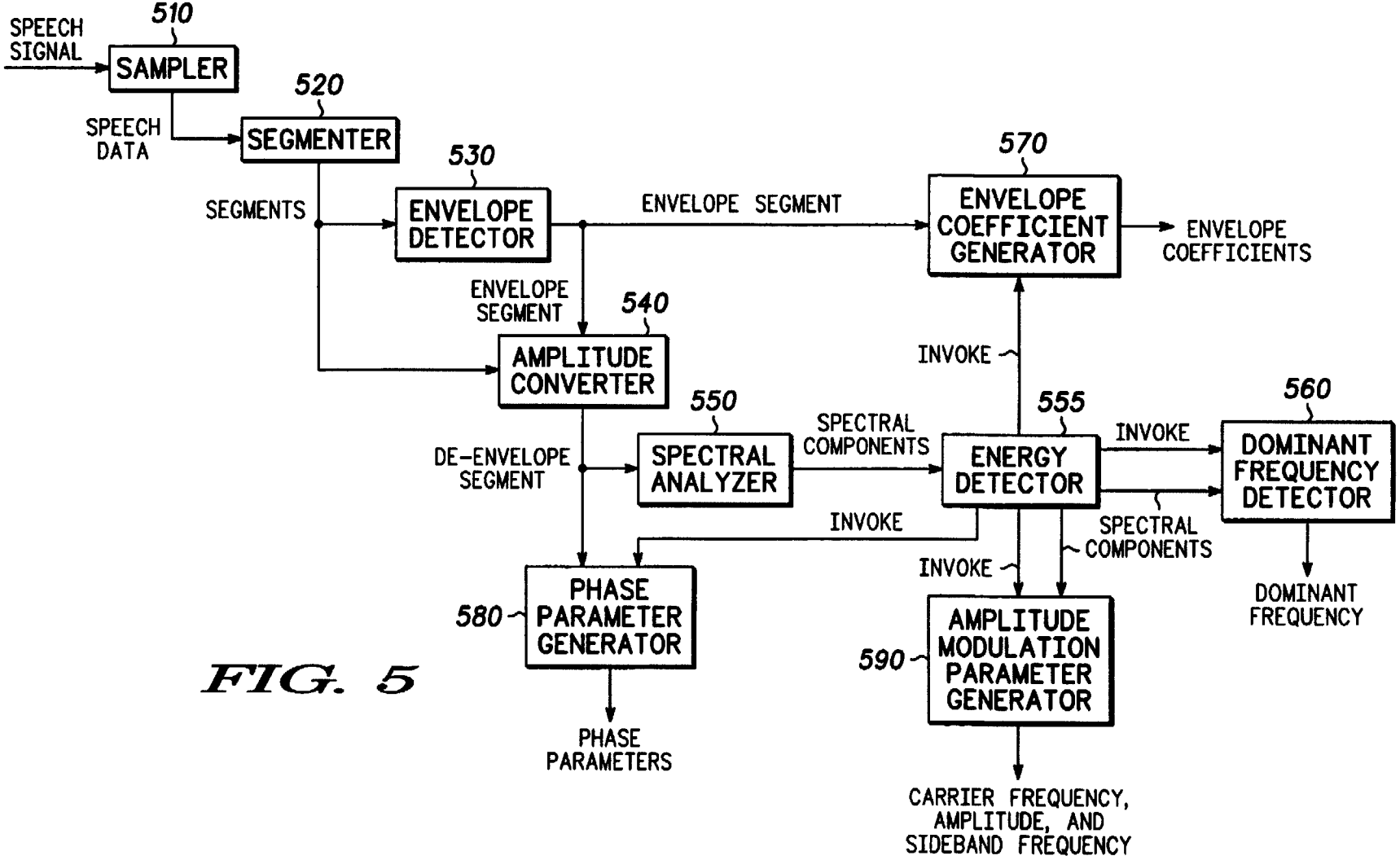
FIG. 5 is a block diagram of the speech compression system provided in accordance with a preferred embodiment of the invention.

FIG. 5 is a block diagram of the speech compression system provided in accordance with a preferred embodiment of the invention. The preferred embodiment of the invention may be implemented as a hardware embodiment or a software embodiment, depending on the resources and objectives of the designer. In a hardware embodiment of the invention, the system of FIG. 5 is implemented as one or more integrated circuits specifically designed to implement the preferred embodiment of the invention as described herein. In one aspect of the hardware embodiment, the integrated circuits include a polynomial processor circuit as described above, designed to perform the polynomial functions in the preferred embodiment of the invention. For example, the polynomial processor is included as part of the envelope coefficient generator and the phase parameter generator. Alternatively, in a software embodiment of the invention, the system of FIG. 5 is implemented as software executing on a computer, in which case the blocks refer to specific software functions realized in the digital circuitry of the computer.

In FIG. 5, a sampler 510 receives a speech signal and samples the speech signal periodically to produce a sequence of speech data. The speech signal is an analog signal which represents actual speech. The speech signal is, for example, an electrical signal produced by a transducer, such as a microphone, which converts the acoustic energy of sound waves produced by the speech to electrical energy. The speech signal may also be produced by speech previously recorded on any appropriate medium. The sampler 510 periodically samples the speech signal at a sampling rate sufficient to accurately represent the speech signal in accordance with the Nyquist theorem. The frequency of detectable speech falls within a range from 100 Hz to 3400 Hz. Accordingly, in an actual embodiment, the speech signal is sampled at a sampling frequency of 8000 Hz. Each sampling produces an 8-bit sampling value representing the amplitude of the speech signal at a corresponding sampling point. The sampling values become part of the sequence of speech data in the order in which they are sampled. The sampler 510 employs, for example, a conventional analog to digital converter. One of ordinary skill in the art will readily implement the sampler 510 as described above.

A segmenter 520 receives the sequence of speech data from the sampler 510 and segments the sequence of speech data into at least one subsequence of segmented speech data, referred to herein as a segment. Because the preferred embodiment of the invention employs curve-fitting techniques, the speech signal is compressed more efficiently by compressing each segment individually. In an actual embodiment, the sequence of speech data is segmented into segments of 256 8-bit sampling values. One of ordinary skill in the art will easily implement the segmenter 520 in accordance with the description herein.

An envelope detector 530 receives the segments from the segmenter 520 and detects an envelope of each segment of the speech signal to produce a subsequence of envelope data, called herein an envelope segment. Modulation of the envelope allows for the derivation of a minimal number parameters which accurately describe each segment, as will be described in more detail below. The envelope detector is, for example, an amplitude peak detector which detects peak amplitudes of the segment. That is, for a segment, the peak amplitude points which define the envelope are:

$$\left\{ k_1, (1/k_1) \sum_{k=1}^{k_1} |f(k)| \right\},$$

$$\left\{ k_2, (1/(k_2 - k_1)) \sum_{k=k_1}^{k_2} |f(k)| \right\}, \ldots$$

-continued $$\left\{ k_m, (1/(k_m - k_{m-1})) \sum_{k=k_{m-1}}^{k_m} |f(k)| \right\}.$$

wherein $k_i$ are sampling points (20 to 120 sampling points, in one embodiment) and wherein $1/(k_i-k_{i-1})\ \Sigma|f(k)|$ are the average amplitude values between $k_{i-1}$ and $k_i$. Alternatively, the envelope detector is an envelope filter circuit which truncates the segmented data in the segment which falls below a predetermined threshold to form a subsequence of truncated data, and low-pass filters the subsequence of truncated data to form the envelope data. One of ordinary skill in the art will easily employ either method of detecting the envelope and may recognize yet other methods of detecting the envelope which are appropriate for the implementation and circumstances at hand.

An amplitude converter 540 receives each segment from the segmenter 520 and receives each envelope segment from the envelope detector 530. The amplitude converter 540 divides each datum of the segment by a corresponding datum of the envelope segment derived from that segment to form a subsequence of de-envelope data, referred to herein as a de-envelope segment. The corresponding datum is the envelope datum derived from the same sampling point of the speech signal as the corresponding segment datum. One of ordinary skill in the art will easily implement the amplitude converter 540 based on the description herein.

Figure 6:
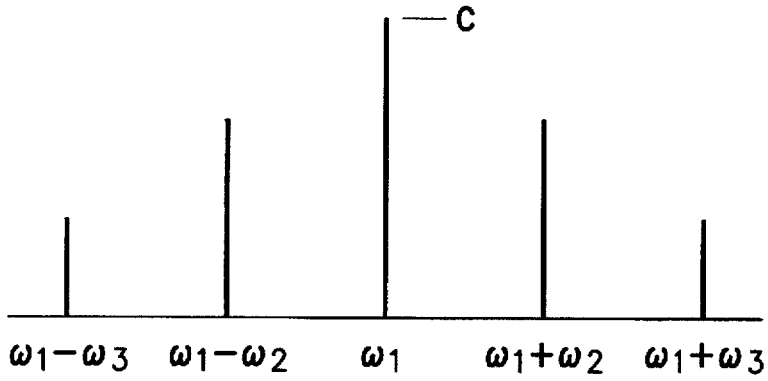
FIG. 6 is an illustration of an amplitude modulation component provided in accordance with a preferred embodiment of the invention.

A spectral analyzer 550 receives the de-envelope segment from the amplitude converter 540 and transforms the de-envelope segment into one or more spectral components. The spectral analyzer 550 utilizes, for example, a hardware or software implementation of a Fast-fourier transform applied to the de-envelope data in the de-envelope segment. Alternatively, the spectral analyzer 550 utilizes a hardware or software implementation of a Discrete fourier transform applied to the de-envelope data in the de-envelope segment. The spectral analyzer 550 thus produces as the spectral components a series of amplitudes of the de-envelope segment at different frequencies in the spectrum. For example, as shown in FIG. 6, which will be explained later in more detail, several spectral components of the de-envelope segment are shown at several different frequencies, where C is the amplitude of the frequency $\omega_1$. One of ordinary skill in the art will readily implement the spectral analyzer 550 based on the description herein.

An energy detector 555 receives the spectral components for each segment from the spectral analyzer 550. The energy detector 555 determines whether the segment is voiced or unvoiced. Specifically, the energy detector 555 determines an energy of the de-envelope segment based on the spectral components and compares the energy of the de-envelope segment to an energy threshold. If the energy in the de-envelope data is less than the energy threshold, the segment is unvoiced. Otherwise, the segment is voiced. If the segment is voiced, the energy detector invokes a dominant frequency detector 560, an envelope coefficient generator 570 and a phase parameter generator 580. If the segment is unvoiced, the energy detector 555 invokes an amplitude modulation parameter generator 590.

The dominant frequency detector 560 receives the spectral components from the energy detector 555 when invoked by the energy detector 555 for a voiced segment. The dominant frequency detector 560 determines a predetermined number of dominant frequencies corresponding to the predetermined number of dominant spectral components having the greatest magnitudes among the spectral components. For example, if three dominant frequencies are to be determined, the frequencies corresponding to the three spectral components having the greatest magnitude are determined to be the dominant frequencies. Again using FIG. 6, which will be explained in more detail later, as an example, if the five spectral components shown in FIG. 6 were the five spectral components of the greatest magnitude in a segment, then the frequencies $\omega_1$, $\omega_1-\omega_2$ and $\omega_1+\omega_2$ would be the three dominant spectral components of the segment. One of ordinary skill in the art will easily implement the dominant frequency detector based on the description herein.

The envelope coefficient generator 570 receives the envelope segment from the envelope detector 530 when invoked by the energy detector 555 for a voiced segment. The envelope coefficient generator 570 generates one or more envelope coefficients by fitting the envelope segment to a polynomial function. The envelope coefficient generator 570 is, for example, a hardware or software implementation of a curve-fitting technique such as a least-squares method or a matrix-inversion method applied to fit the envelope segment to the polynomial function. In the preferred embodiment of the invention, the polynomial function is a second order polynomial $y(t)=a+bt+ct^2$. Alternatively, the polynomial function used may be a linear function, a third or fourth order polynomial, etc. For example, where the envelope detector is an amplitude peak detector as described above, and where m>3 such that there are more than 3 points $k_1 \ldots k_m$, then preferably a third order polynomial is used instead of the second order polynomial described above. One of ordinary skill in the art will select the polynomial function based on the objectives of the system at hand and will readily implement the envelope coefficient generator 570 based on the description herein.

The phase parameter generator 580 receives the de-envelope segment from the amplitude converter 540, when invoked by the energy detector 555 for a voiced segment and generates one or more phase parameters representing a phase of each of the dominant spectral components. The phase parameter generator 580 is, for example, a hardware or software implementation of a curve-fitting technique, such as a least-squares method or a matrix-inversion method, applied to fit the de-envelope segment to a modeling equation. In the preferred embodiment of the invention, the de-envelope segment is fit to the function F(t) to reduce error between the de-envelope segment and F(t) over discrete values of t, such that:

$$F(t)=\sum_{i=1}^{n}(A_i\cos\omega_i t+B_i\sin\omega_i t)$$

wherein $A_i$ and $B_i$ are the phase parameters, and wherein $\omega_i$ are the dominant frequencies for each sampling i of n samplings of the speech signal. One of ordinary skill in the art will readily implement the phase parameter generator 580 based on the description herein and may recognize other modeling equations suited to the circumstances at hand.

The amplitude modulation parameter generator 590 receives the spectral components from the energy detector 555 when invoked by the energy detector 555 and identifies an amplitude modulation component from among the spectral components. The amplitude modulation parameter generator 590 then determines a carrier frequency, an amplitude and at least one sideband frequency of the amplitude modulation component. FIG. 6 is an illustration of an amplitude modulation component provided in accordance with a preferred embodiment of the invention. FIG. 6 shows an amplitude modulation component selected from among the spectral components. The amplitude modulation parameter generator 590 identifies the amplitude modulation component by determining the spectral component with the greatest magnitude. The frequency corresponding to the spectral component with the greatest magnitude is the carrier frequency. The frequencies corresponding to the spectral components adjacent to the spectral component with the greatest magnitude are sideband frequencies. The amplitude modulation component is shown with five frequencies. In this case, $\omega_1$ is the carrier frequency, $\omega_2$ is a first sideband frequency and $\omega_3$ is a second sideband frequency. C is the amplitude of the carrier frequency $\omega_1$. The determination of the amplitude modulation component, the carrier frequency, amplitude and sideband frequency will be easily accomplished by one of ordinary skill in the art based in accordance with the description herein.

In the case of a voiced speech segment, the dominant frequencies produced by the dominant frequency detector 560, the envelope coefficients produced by the envelope coefficient generator 570, and the phase parameters produced by the phase parameter generator 580 are generated as the portion of the compressed speech data for the voiced segment. For example, the numeric values of the dominant frequencies, the overlap coefficients and phase parameters are assigned to a portion of a data structure allocated to contain the speech data. By reducing the voiced segment of speech data to the dominant frequencies, the envelope coefficients and the phase parameters, a significant compression of the speech signal is achieved. Further, because the dominant frequencies, the envelope coefficients and the phase parameters so accurately represent the original portion of the speech signal corresponding to the voiced segment, this significant compression is achieved without a substantial loss of quality or recognizability of the speech signal.

In the case of an unvoiced speech segment, the carrier frequency, amplitude and sideband frequency of the amplitude modulation component produced by the amplitude modulation parameter generator 590 are generated as the portion of the compressed speech signal for the unvoiced segment in the manner described above. By reducing the unvoiced segment of speech data to the carrier frequency, amplitude and sideband frequency of the amplitude modulation component, an even greater compression is realized for unvoiced speech. Because unvoiced speech can be represented accurately with less description, as is well known, the even greater compression realized for unvoiced speech is achieved also without a substantial loss of quality or recognizability of the speech signal.

The method and system for compressing a speech signal using envelope modulation described above provides the advantages of a high speech compression ratio with minimized loss of speech quality. The envelope modulation allows for the generation of a minimal number of parameters which accurately describe each segment. The compressed speech data can be efficiently stored by a computer or other digital device. The compressed speech data can also be efficiently transferred among computers or other digital devices via a communications medium. While specific embodiments of the invention have been shown and described, further modifications and improvements will occur to those skilled in the art. It is understood that this invention is not limited to the particular forms shown and it is intended for the appended claims to cover all modifications of the invention which fall within the true spirit and scope of the invention.

What is claimed is:

1. A method for compressing a speech signal into compressed speech data, the method comprising the steps of:

sampling the speech signal to form a sequence of speech data;

segmenting the sequence of speech data into at least one subsequence of segmented speech data;

detecting an envelope of the subsequence of segmented speech data to form a subsequence of envelope data;

dividing each datum of the subsequence of segmented speech data by a corresponding datum of the subsequence of envelope data to form a subsequence of de-envelope data;

transforming the subsequence of de-envelope data into one or more spectral components;

determining a predetermined number of dominant frequencies corresponding to dominant spectral components, the dominant spectral components being the predetermined number of the spectral components having greatest magnitudes;

generating one or more envelope coefficients by fitting the subsequence of envelope data to a polynomial function; and generating one or more phase parameters representing a phase of each of the dominant spectral components, wherein the compressed speech data includes the dominant frequencies, the envelope coefficients and the phase parameters.

2. The method of claim 1 wherein the step of sampling the speech signal includes using an analog to digital converter.

3. The method of claim 1 wherein the step of detecting the envelope includes determining peak amplitudes of the subsequence of segmented speech data.

4. The method of claim 1 wherein the step of detecting the envelope includes the steps of truncating the subsequence of segmented speech data below a threshold to form a subsequence of truncated data, and low-pass filtering the subsequence of truncated data to form the envelope data.

5. The method of claim 1 wherein the step of transforming the subsequence of de-envelope data into one or more spectral components includes using a fast-Fourier transform.

6. The method of claim 1 wherein the step of transforming the subsequence of de-envelope data into one or more spectral components includes using a discrete Fourier transform.

7. The method of claim 1 wherein the step of generating a plurality of envelope coefficient includes using a curve-fitting technique.

8. The method of claim 7 wherein the curve-fitting technique includes a least-squares method.

9. The method of claim 7 wherein the curve-fitting technique includes a matrix-inversion method.

10. The method of claim 1 wherein the step of generating the phase parameters includes the step of fitting the subsequence of de-envelope data to F(t) to reduce error between the subsequence of de-envelope data and F(t) over discrete values of t, wherein $$F(t) = \sum_{i=1}^{n} (A_i \cos\omega_i t + B_i \sin\omega_i t)$$

wherein $A_i$ and $B_i$ are the phase parameters, and wherein are the dominant frequencies.

11. The method of claim 10 wherein the step of fitting the subsequence of de-envelope data to F(t) includes a least-squares method.

12. The method of claim 10 wherein the step of fitting the subsequence of de-envelope data to F(t) includes a matrix inversion method.

13. The method of claim 1, further comprising the steps of:

determining an energy in the subsequence of de-envelope data based on the spectral components;

comparing the energy in the subsequence of de-envelope data to an energy threshold; and identifying, if the energy in the subsequence of de-envelope data is less than the energy threshold, an amplitude modulation component from the spectral components, and determining a carrier frequency, an amplitude and at least one sideband frequency of the amplitude modulation component, wherein the compressed speech data includes the carrier frequency, the amplitude and the sideband frequency of the amplitude modulation component.

14. A system for compressing a speech signal into compressed speech data, the system comprising:

a sampler for sampling the speech signal to form a sequence of speech data;

a segmenter, coupled to the sampler, for segmenting the sequence of speech data into at least one subsequence of segmented speech data;

an envelope detector, coupled to the segmenter, for detecting an envelope of the subsequence of segmented speech data to form a subsequence of envelope data;

an amplitude converter, coupled to the segmenter and to the envelope detector, for dividing each datum of the subsequence of segmented speech data by a corresponding datum of the subsequence of envelope data to form a subsequence of de-envelope data;

a spectral analyzer, coupled to the amplitude converter, for transforming the subsequence of de-envelope data into one or more spectral components;

a dominant frequency detector, coupled to the spectral analyzer, for determining a predetermined number of dominant frequencies corresponding to dominant spectral components, the dominant spectral components being the predetermined number of the spectral components having greatest magnitudes;

an envelope coefficient generator, coupled to the envelope detector, for generating one or more envelope coefficients by fitting the subsequence of envelope data to a polynomial function; and a phase parameter generator, coupled to the amplitude converter, for generating one or more phase parameters representing a phase of each of the dominant spectral components, wherein the compressed speech data includes the dominant frequencies, the envelope coefficients and the phase parameters.

15. The system of claim 14 wherein the sampler comprises an analog to digital converter.

16. The system of claim 14 wherein the envelope detector determines peak amplitudes of the subsequence of segmented speech data.

17. The system of claim 14 wherein the envelope detector truncates the subsequence of segmented speech data below a threshold to form a subsequence of truncated data, and low-pass filters the subsequence of truncated data to form the envelope data.

18. The system of claim 14 wherein the envelope coefficient generator performs a curve-fitting technique.

19. The system of claim 14 wherein the phase parameter generator fits the subsequence of de-envelope data to F(t) to reduce error between the subsequence of de-envelope data and F(t) over discrete values of t, wherein $$F(t) = \sum_{i=1}^{n} (A_i \cos\omega_i t + B_i \sin\omega_i t)$$

wherein $A_i$ and $B_i$ are the phase parameters, and wherein $\omega_i$ are the dominant frequencies.

20. The system of claim 14, further comprising:

an energy detector, coupled to the spectral analyzer, for determining an energy in the subsequence of de-envelope data based on the spectral components, comparing the energy to an energy threshold and, if the energy is less than the energy threshold, invoking an amplitude modulation parameter generator, the amplitude modulation parameter generator identifying an amplitude modulation component from the spectral components and determining a carrier frequency, an amplitude and at least one sideband frequency of the amplitude modulation component, wherein the compressed speech data includes the carrier frequency, the amplitude and the sideband frequency of the amplitude modulation component.

* * * * *